US005264003A

United States Patent [19]

Ross et al.

[11] Patent Number: 5,264,003

[45] Date of Patent: Nov. 23, 1993

[54] GELLED FUEL HEAT SOURCE

[76] Inventors: Jon Ross, Rte. 2, Box 83, San Antonio, Tex. 78218; Allen C. Ludwig, 5914 Brenda La., San Antonio, Tex. 78240

[21] Appl. No.: 834,610

[22] Filed: Feb. 12, 1992

[51] Int. Cl.[5] ..... C10L 7/00

[52] U.S. Cl. ..... 44/266; 44/265

[58] Field of Search ..... 44/266, 265

[56] References Cited

U.S. PATENT DOCUMENTS

| | | | |
|---|---|---|---|
| 2,908,720 | 10/1959 | Linn | 44/265 |
| 3,525,689 | 8/1970 | Marotta | 44/266 |
| 3,729,415 | 4/1973 | Davis et al. | 252/25 |
| 4,293,314 | 10/1981 | Stull | 44/265 |
| 4,732,575 | 3/1988 | Forschirm | 44/265 |
| 4,756,719 | 7/1988 | Saito | 44/265 |

FOREIGN PATENT DOCUMENTS

| | | | |
|---|---|---|---|
| 2083075 | 3/1982 | United Kingdom | 44/266 |

*Primary Examiner*—Margaret B. Medley
*Attorney, Agent, or Firm*—Donald R. Comuzzi

[57] ABSTRACT

A stable gelled material used as a fuel which consists of a composition of diethylene glycol mixed with a gelling agent of fumed silica. Polyethylene glycol may also be added to improve its burning characteristics.

3 Claims, No Drawings

GELLED FUEL HEAT SOURCE

BACKGROUND OF THE INVENTION

1. Field of the Invention

The present invention relates to gelled diethylene glycol to be used as a heat source or fuel. More particularly, this invention relates to a composition of matter consisting essentially of diethylene glycol and a fumed silica product.

2. Description of the Prior Art

Portable heat sources have been used for many years including, campers and military personnel. To avoid the bulk and impracticality of liquid sources inherent in camp stoves, a number of devices have been invented to provide a source of fuel in a gelled or colloidal form. One such device is a gelled alcohol marketed as STERNO. Because of its volatile characteristics inherent in alcoholic compositions, this device suffers from several limitations and disadvantages. First, when ignited, the heat degenerates the gel to a liquid form, which may spread a fire rapidly if spilled. Further, due to its volatile nature, it emits fumes and a considerable odor when burned which are harmful to the health of those in close proximity.

Another gelled heat source is disclosed and defined in U.S. Pat. No. 4,302,208. This invention relates to a fuel for fuel air explosive devices for military uses and its composition consists of a polar fuel, silicon dioxide and a mixture of two alcohols. One of the alcohol compositions contains an ether linkage, with volatile characteristics with such limitations as described above.

Another fuel source is disclosed and defined in U.S. Pat. No. 4,756,719. This invention relates to a composition consisting of a combustible polymer, an organic solvent and a course powder of fiber material. The disadvantage and limitations inherent in organic based fuels are its tendencies to evaporate quickly and emit fumes and odors which may be poisonous or noxious.

It is therefore, an object of the present invention to provide a small efficient gelled fuel heat source primarily for field use in heating food and which is neither poisonous or noxious and which does not evaporate quickly. It is a further object of the present invention to provide a fuel source which maintains its high degree of viscosity over a long shelf life and during turbulent handling and shipping conditions.

The present invention represents an improved and novel composition. It is characterized by a number of advantages which increases its utility over prior art heat sources. These and other objects and advantages of the present invention will become evident from the following disclosure to those skilled in the art to which this invention pertains.

SUMMARY OF THE INVENTION

The preferred embodiment of the present invention relates to a gelled fuel heat source consisting of diethylene glycol and a fumed silicon product. Use of diethylene glycol as a fuel source has many advantages over the prior art such as alcohol and organic based fuel sources. Diethylene glycol burns clearly without fumes or odor. When mixed with a fumed silica product as a gelling agent, a gel forms with a high degree of viscosity capable of being packaged in an envelope, can, or tube. Addition of the fumed silica product produces good wicking characteristics with a high flash point. Further, the diethylene glycol contributes a high caloric value to the gel which requires only a small portion for each use. The composition may be used directly a field use includes fuel for heating food or as a starter for igniting firewood.

This is a mechanical means for gelling, however, several chemical means have also been found to produce desirable results.

One chemical means for gelling or solidifying the diethylene glycol was to react the diethylene glycol with stearic acid. When 5 percent to 40 percent by weight of stearic acid is heated with the diethylene glycol until dissolved, upon cooling, a wax-like candle is formed. Because the material is semi-solid, a conventional wick can be used to ignite the material. If I to 5% of fumed silica is added to the total mixture, sufficient wicking is provided by the silica alone. One added feature of this mixture, if reacted long enough, is that the material can be used as a soap in addition to being a fuel source.

A second means of chemically gelling or solidifying diethylene glycol is to react it with 10 percent to 40 percent by weight of polyethylene glycol. This mixture must also be heated to dissolve the polyethylene glycol. If 1 percent to 5 percent by weight of fumed silica is added for wicking, an easily ignitable mixture can be prepared which burns with a pale blue flame, that is very difficult to extinguish.

Another means of chemically gelling diethylene glycol is to react it with 10 percent to 40 percent by weight of polyvinyl alcohol. When heated to 200° F to 300° F and cooled to room temperature, the mixture forms a rubbery semi-solid material. While burning it melts like a wax candle.

DESCRIPTION OF THE PREFERRED EMBODIMENT

The composition of this invention is made up by mixing diethylene glycol and a fumed silica product. This very fine silica product increases the viscosity of the diethylene glycol from a liquid to a gelled form. Such silica products are commercially available under the trade names CAB-0-SIL and AEROSIL. Even though the vapor pressure is very low for diethylene glycol, the fumed silica acts like a wick for the mixture and can be easily ignited with a match. The product when heated does not melt or soften but remains in its semi-solid condition. It burns clean with no smoke or odor and leaves only the silica residue.

It has been discovered that while this composition has desirable viscous characteristics upon formulation, it has a tendency to become less viscous with severe agitation. A trace quantity of a caustic compound when added to the aforementioned composition will stabilize the viscous characteristics of the gelled mixture. Examples of caustic compounds suitable for use include sodium hydroxide, potassium hydroxide, and calcium oxide. Tests have disclosed that traces of a caustic compound in the range of about 0.05 to 0.5 percent by weight is sufficient to retain the gel's viscous characteristics.

The preferred weight percentages for the composition consists of 5 to 25 percent of fumed silica, 75 to 95 percent diethylene glycol and 0.05 to 0.5 percent of a caustic compound.

In an alternative composition, fly ash may be used to replace some of the more expensive fumed silica in a range of I0 to 40 percent by weight. This substitution may result in more than a 50 percent formulation cost savings using a mix by weight of fly ash of 40 percent and a 2 percent mix by weight of fumed silica. Additionally, the fly ash provides the caustic characteristics which retains the viscous quality of the gelled composition.

The composition may be packaged with military field rations where a simple envelop would be used to heat water for soup and coffee. The tubes will also find ready application among the military, scouters, and campers. The canned material can be used.

The compositions of the present invention when prepared according to the ranges of weight percentages set forth above, may be packaged in a variety of manners. For single use applications, the gel may be packaged in envelopes of aluminum foil, plastics, or plastic lined paper. For multiple use applications, the gel may be packaged in plastic or foil tubes (like toothpaste), and the desired amount can be squeezed out and ignited. Additionally, the gel may also be packaged in metal cans of various shapes.

We claim:

1. A gelled heat source consisting essentially of a composition of:
   diethylene glycol;
   1 to 5 percent by weight of fumed silica; and
   10 to 40 percent by weight of polyethylene glycol.

2. A gelled heat source consisting essentially of a composition of:
   diethylene glycol;
   5 to 25 percent by weight of fumed silica; and
   0.05 to 0.5 percent by weight of an alkali metal hydroxide or alkaline metal oxide compound.

3. A gelled heat source consisting essentially of a composition of:
   diethylene glycol;
   2 percent by weight fumed silica; and
   10 to 40 percent by weight of fly ash.

* * * * *